United States Patent [19]

Katz et al.

[11] 4,127,085

[45] Nov. 28, 1978

[54] AUTOMATIC HOT WATER HEATER

[76] Inventors: Wilfred L. Katz; Donald J. Katz, both of 27036 John R St., Madison Heights, Mich. 48071

[21] Appl. No.: 846,796

[22] Filed: Oct. 31, 1977

[51] Int. Cl.[2] ..... F23N 1/08; F22B 9/04

[52] U.S. Cl. ..... 122/18; 122/448 R; 126/351; 236/25 R

[58] Field of Search ..... 122/18, 448 R, 451 R, 122/504; 126/351; 236/25 R

[56] References Cited

U.S. PATENT DOCUMENTS

| | | | |
|---|---|---|---|
| 1,862,630 | 6/1932 | Morrow | 122/18 |
| 2,814,279 | 11/1957 | Thomas | 122/18 |
| 2,901,175 | 8/1959 | Keppel | 236/25 |
| 2,972,445 | 2/1961 | Keppel | 236/25 |
| 3,139,067 | 6/1964 | Van Den Broek et al. | 122/18 |

*Primary Examiner*—Kenneth W. Sprague
*Attorney, Agent, or Firm*—Cullen, Sloman, Cantor, Grauer, Scott, & Rutherford

[57] ABSTRACT

In an automatic water heater having a casing, a support base, a water tank with an outlet in its top wall, and a hot water intake in its bottom wall, a combustion chamber in said base including a bonnet having an exhaust outlet, and a flue pipe axially disposed through said tank connected to said bonnet outlet, the improvement which comprises a cast iron gas burner supported on said base having a gas inlet. A series of spirally arranged continuous copper pipe coils are nested within the bonnet overlying said burner having a cold water inlet at said base and an outlet connected to the hot water intake. A hot water delivery pipe at one end is connected to the tank outlet and has at least one water faucet. An electronic igniter extends into the combustion chamber and includes an electrical circuit with power means for intermittently activating said igniter. A gas delivery pipe is connected to said gas inlet and includes a normally enclosed solenoid actuated gas valve. A normally open water pressure switch is mounted upon said hot water delivery pipe in communication with its interior and connected to the normally closed gas valve whereby, opening of a faucet closes said switch to open said gas valve and momentarily energize said igniter.

4 Claims, 3 Drawing Figures

AUTOMATIC HOT WATER HEATER

BACKGROUND OF THE INVENTION

As exemplified in one or more of the following U.S. Pat. Nos.:

1,218,965
1,657,298
1,237,737
2,179,496
1,633,758, it is known to provide controlled amounts of gas to a gas burner within a combustion chamber for heating a water-filled coil for the production of hot water for direct delivery to a hot water system within a building including faucets. Various means have been employed for establishing a heat exchange relationship between such coils and a water supply or with respect to a tank within the casing for heating the water therein. As distinguished from the use of pilot lights, the use of electronic ignition in itself for hot water heaters is known as shown in the Crane U.S. Pat. No. 1,657,298 and Toles U.S. Pat. No. 1,218,965.

SUMMARY OF THE INVENTION

It is the object of the present invention to provide an improved automatic hot water heater which includes electronic ignition as one element of the combination, and in connection therewith, a hot water storage tank, and an efficient means of transmitting heat from the products of combustion from a cast iron gas burner to a continuous spiral water conduit connected to a cold water source for providing delivery of hot water into a tank. It is a further object to provide a water pressure-responsive switching mechanism within a control circuit in the combination and wherein, upon the calling for water and the opening of the faucet with a slight reduction in pressure, the corresponding switch is closed to energize the igniter and simultaneously open the solenoid-controlled gas gate valve.

It is another object to provide an improved and more efficient hot water heater than heretofore provided and wherein, a series of elements are brought together in a novel combination.

These and other objects will be seen from the following specification and claims in conjunction with the appended drawing.

THE DRAWING

Figure 1:
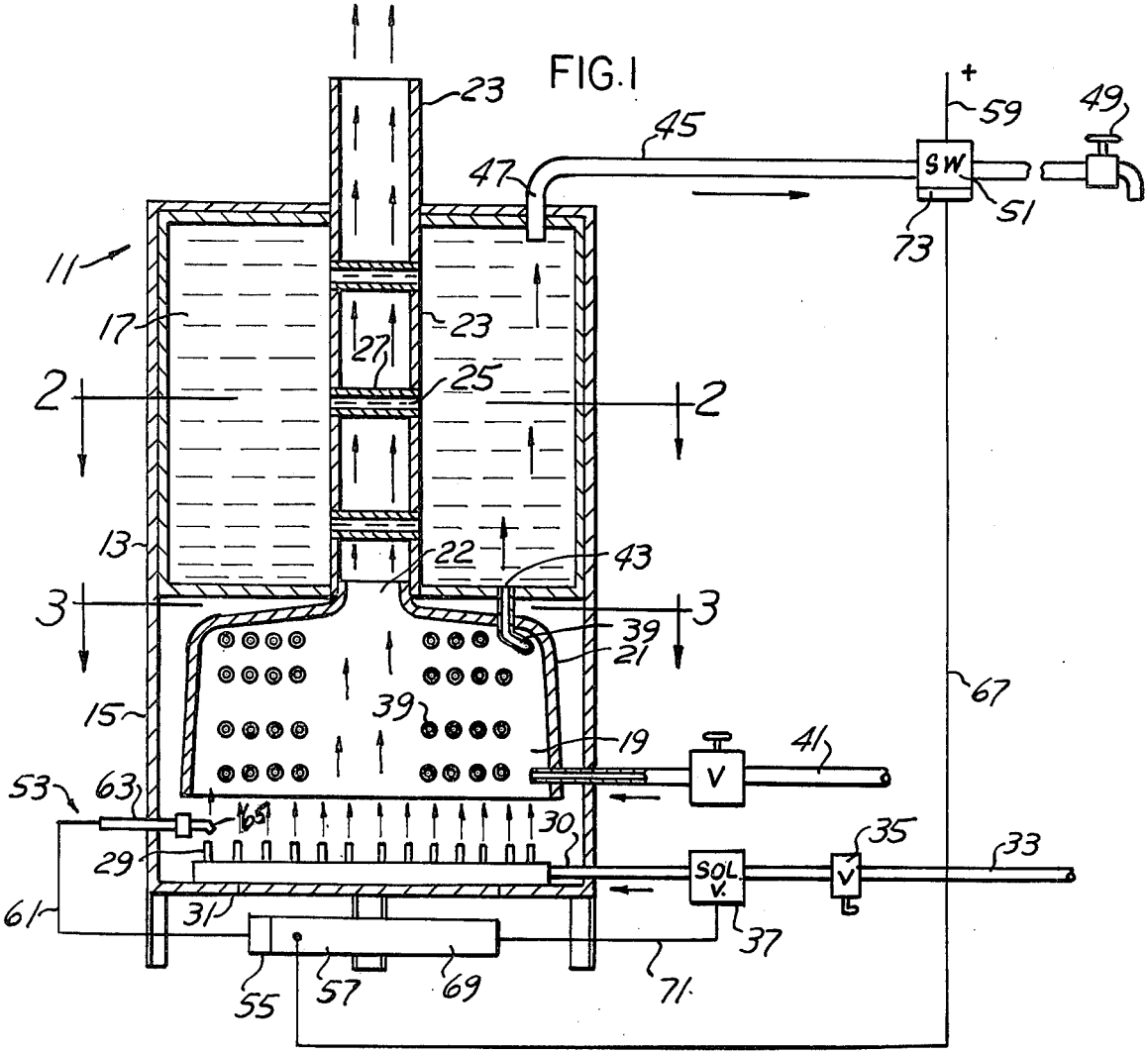
FIG. 1 is a vertical section of the present hot water heater.
Figure 2:
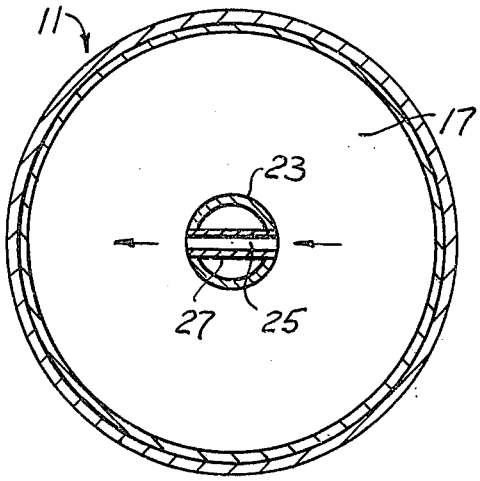
FIG. 2 is a plan section taken in the direction of arrows 2—2 of FIG. 1.
Figure 3:
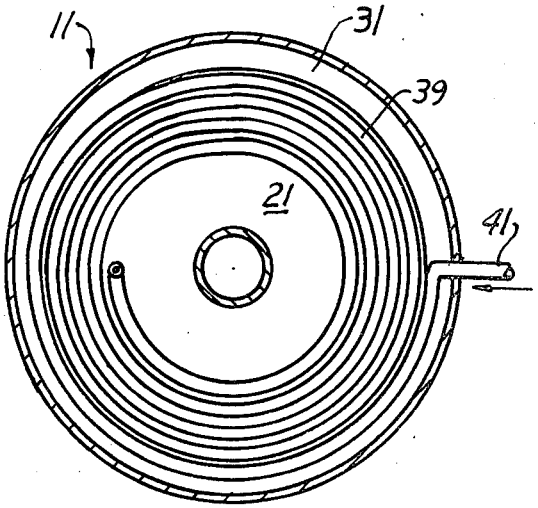
FIG. 3 is a section taken in the direction of arrows 3—3 of FIG. 1.

It will be understood that the above drawing illustrates merely a preferred embodiment of the invention, and that other embodiments are contemplated within the scope of the claims, hereafter set forth.

DETAILED DESCRIPTION OF THE INVENTION

Referring to the drawing, the present hot water heater, generally designated at 11, includes an upright insulated casing 13 having a support base 15 including legs and within the top of said casing, a hot water storage tank 17.

Within said base is a combustion chamber 19 overlying which is a formed bonnet 21 having a central outlet 22.

The upright flue 23 is axially disposed within said casing and extends through the water tank and at its lower end, is connected to the bonnet outlet 22. The upper end of said flue projects through the top of the tank through the casing top and is adapted to outlet to atmosphere or through a suitable chimney, not shown in the drawing.

Along the length of the flue 23 within the water tank 17 are a series of longitudinally spaced transverse tubes 27 which establish fluid communication at their opposite ends with the water within the tank 17 for communication therethrough and for increased heat exchange with respect to the exhaust gases passing through said flue.

A further function of the transverse tubes 27 is that they slow down the flow of the products of combustion and gases moving upwardly through the flue to, thus, provide for the prolonged and increased exchange of heat therefrom through the casing walls to the water within tank 17.

Arranged upon suitable brackets 31 within the base 15 is a cast iron burner 29 within combustion chamber 19 and below the bonnet 21 and having a gas inlet 30. The elongated gas pipe 33 adapted for connection to a source of gas under pressure is connected to said gas inlet 30 and includes a conventional shut off valve 35. A normally closed solenoid controlled gate valve 37 is interposed upon the gas pipe line 33, normally closing off the flow of gas under pressure into said burner.

A series of continuous hot water coils, preferably of copper, are nested within the combustion chamber above said burner and within the space adjacent the bonnet 21. Said coils include a cold water intake 41 within the base adjacent the bottom of said casing and a hot water outlet 43 which communicates with the interior of the tank 17 through its bottom wall.

Hot water outlet pipe 45 is connected to the tank hot water outlet 47 and forms a part of a water delivery system including at least one faucet schematically shown for delivering hot water.

A water pressure responsive normally open switch 51 is interposed within the hot water pipe 45 so that any reduction of water pressure within said pipe, such as upon opening of the faucet 49 will close said switch to the electrical circuit 61.

An electronic igniter, generally indicated at 53, is arranged adjacent the base 15 for said casing and includes the schematically illustrated spark coil 55 with associated transformer 57 and an electrical circuit 61 to the spark plug 63. Said plug projects through said base and its electrodes 65 are arranged adjacent gas burner 29.

A control assembly 69 is arranged adjacent base 15 mounting the above described coil and transformer. Said control assembly has connected thereto the lead wire 67 which extends to the normally open pressure switch 51. An electrical power source 59 is connected to the lead 67 so that electrical energy will be delivered to the control assembly 69 whenever the faucet 49 is opened and switch 51 closed. Lead 71 interconnects the control assembly 69 with the normally closed solenoid control valve 37 for the gas line whereby, upon opening of a faucet at 49, the normally open pressure switch 51 is closed to the power source 59 for the delivery of electrical power to the control assembly 69. The control assembly, through the transformer and coil and circuit 61, intermittently energizes the spark plug 63 of the electronic igniter and at the same time, through the lead 71, activates the solenoid for the normally closed solenoid control valve for opening the gas line to permit a supply of gas to be delivered to the burner 29. Such flow may be regulated.

Since it is understood that after initial ignition of the burner, the igniter may be deactivated, accordingly, the control assembly 69 includes a switching means for deactivating the igniter after such initial ignition. The deactivating mechanism is not shown in the present disclosure. However, one such deactivating mechanism is shown in the Crane U.S. Pat. No. 1,657,298. Other more simplified control mechanisms may be employed so that after the initial or intermittent energization of the igniter 53, it will be automatically deactivated though the burner continues to function with gas delivered thereto as long as there is a call for hot water by the opening of one or more of the faucets 49 in the delivery pipe 45.

While normally the closing of the faucet 49 will cause an opening of the pressure switch 51 to cut off the power to the control assembly, there is incorporated within the switch 51 a time delay element 73 whereby, the burner will continue to be activated for a short period, as desired, for adding heat to the supply of water within the tank 17. Switch 51 is normally open. Any drop in water pressure causes it to immediately close.

OPERATION

In operation, cold water from a source of city pressure, is delivered through the cold water intake 41 into the lower end portion of the continuous heating coils or pipes 39 whose outlet adjacent the top of the bonnet 31 projects through the bottom wall of the water tank as at 43, FIG. 1. Hot water accumulates within the tank 17 with additional heat being provided to the water therein by the heat transfer through the flue or stack walls 23 as well as by the water flowing through the transverse passages 27 which extend through said flue. Exhaust gases outlet through the upper portion of the flue above the casing normally into a conventional smoke stack or the like for exhausting to atmosphere.

The hot water heater is substantially coextensive with the interior of the combustion chamber for the maximum transfer of heat from the products of combustion to the continuous coils within the combustion chamber and adjacent the bonnet for providing the maximum amount of hot water for delivery into the bottom of the storage tank 17 forming a part of the automatic heater.

Having described our invention, reference should now be had to the following claims.

We claim:

1. In an automatic water heater having an insulated casing, a support base, a hot water tank within the upper portion of said casing, having an outlet at its top wall and a hot water intake in its bottom wall, a combustion chamber within said base including a bonnet having an exhaust outlet, and a flue pipe axially disposed through said tank connected to said bonnet outlet, with one end projecting from said casing; the improvement comprising:

a cast iron gas burner within and supported on said base having a gas inlet;

a series of spirally arranged continuous copper pipe coils nested within and across the upper area of said combustion chamber above said burner, having a cold-water inlet at said base and an outlet connected to said hot water intake;

a hot water delivery pipe at one end connected to the tank outlet and having at least one water faucet;

an electronic igniter including a spark plug extending into said combustion chamber and including an electrical circuit connected to a power source with power means for intermittently activating said igniter;

a gas delivery pipe connected to said burner inlet and including a normally closed solenoid controlled gas valve;

and a normally closed water pressure switch on said hot water delivery pipe connected into said circuit and connected to said solenoid controlled gas valve; whereby opening of a faucet closes said switch to open said gas valve and momentarily energize said igniter.

2. In the automatic water heater of claim 1, a series of longitudinally spaced conduits extending transversely through said flue, at their opposite ends communicating with the interior of said water tank, for the heat exchange passage of water therethrough and for slowing down the flow of exhaust gases through said flue to increase heat exchange through the flue walls.

3. In the automatic water heater of claim 1, said igniter including in said circuit a coil, a transformer and a control for simulataneously energizing said igniter and said solenoid controlled gas valve.

4. In the automatic hot water heater of claim 1, time delay cut off switch in said circuit for maintaining said gas valve open a short period after the faucet is closed.

* * * * *